US009747827B2

(12) United States Patent
Seo et al.

(10) Patent No.: US 9,747,827 B2
(45) Date of Patent: Aug. 29, 2017

(54) DRIVING CIRCUIT OF DISPLAY DEVICE FOR COMPENSATING IMAGE DATA AND METHOD FOR DRIVING THE SAME

(71) Applicant: LG DISPLAY CO., LTD., Seoul (KR)

(72) Inventors: Seung-Pyo Seo, Daegu (KR); Yong-Kwan Lee, Namyul-ri (KR)

(73) Assignee: LG DISPLAY CO., LTD., Seoul (KR)

( * ) Notice: Subject to any disclaimer, the term of this patent is extended or adjusted under 35 U.S.C. 154(b) by 94 days.

(21) Appl. No.: 14/100,787

(22) Filed: Dec. 9, 2013

(65) Prior Publication Data

US 2014/0184663 A1 Jul. 3, 2014

(30) Foreign Application Priority Data

Dec. 27, 2012 (KR) ..... 10-2012-0154687

(51) Int. Cl.
*G09G 3/20* (2006.01)

(52) U.S. Cl.
CPC ..... *G09G 3/2003* (2013.01); *G09G 2310/027* (2013.01); *G09G 2320/0242* (2013.01); *G09G 2320/0666* (2013.01); *G09G 2320/0673* (2013.01); *G09G 2360/16* (2013.01)

(58) Field of Classification Search
CPC .. G09G 3/2037; G09G 3/2033; G09G 3/3688; G09G 3/2022; G09G 3/3677; G09G 3/3685; G09G 3/2096; G09G 3/3614; G09G 3/14; G09G 3/2003; G09G 2320/0666; G09G 2320/0673; G09G 2320/0242; G09G 2310/027; G09G 2360/16
USPC ..... 345/87–89, 600, 605, 690–691, 204, 211
See application file for complete search history.

(56) References Cited

U.S. PATENT DOCUMENTS

| | | | | |
|---|---|---|---|---|
| 5,469,190 | A | 11/1995 | Masterson | |
| 2001/0048431 | A1* | 12/2001 | Laffargue | G09G 3/2022 345/204 |
| 2002/0089701 | A1 | 7/2002 | Lu et al. | |
| 2003/0122754 | A1* | 7/2003 | Bu | 345/87 |
| 2004/0227747 | A1* | 11/2004 | Ishibashi et al. | 345/204 |
| 2005/0062764 | A1* | 3/2005 | Park et al. | 345/690 |
| 2005/0111046 | A1* | 5/2005 | Kurumisawa et al. | 358/3.06 |
| 2006/0077491 | A1* | 4/2006 | Morita | 358/519 |
| 2006/0125752 | A1* | 6/2006 | Moh | G09G 3/3614 345/90 |

(Continued)

FOREIGN PATENT DOCUMENTS

CN 101162571 A 4/2008

OTHER PUBLICATIONS

Office Action dated Nov. 2, 2015 for corresponding Chinese Patent Application No. 201310665265.9, 17 pages.

(Continued)

*Primary Examiner* — Jennifer Mehmood
*Assistant Examiner* — James Nokham
(74) *Attorney, Agent, or Firm* — Brinks Gilson & Lione

(57) ABSTRACT

A driving circuit of a display device and a method for driving the same are disclosed. The driving circuit includes a timing controller configured to receive external image data and to output corrected image data by subtracting predetermined compensation data from the received image data, and a data driver configured to generate a data voltage for the image data based on the corrected image data received from the timing controller.

19 Claims, 11 Drawing Sheets

(56) References Cited

U.S. PATENT DOCUMENTS

| | | | | |
|---|---|---|---|---|
| 2007/0029585 | A1* | 2/2007 | Lee | G09G 3/3677 257/270 |
| 2007/0052736 | A1* | 3/2007 | Inazumi | G06F 3/14 345/690 |
| 2008/0068404 | A1* | 3/2008 | Ishii | G09G 3/20 345/690 |
| 2008/0084432 | A1* | 4/2008 | Jeon | 345/690 |
| 2008/0266236 | A1* | 10/2008 | Shen et al. | 345/102 |
| 2008/0309602 | A1* | 12/2008 | Hwang | 345/89 |
| 2010/0127959 | A1* | 5/2010 | Su | G09G 3/2096 345/88 |
| 2010/0207967 | A1* | 8/2010 | Baek | G09G 3/3685 345/690 |
| 2011/0090198 | A1* | 4/2011 | Hsueh | G09G 3/3688 345/211 |

OTHER PUBLICATIONS

Office Action dated Jun. 21, 2016 for Chinese Application No. 201310665265.9, 9 pages.

* cited by examiner

FIG. 7A

| GRAY LEVEL | IMAGE DATA (8 BITS) | | | | | | | |
|---|---|---|---|---|---|---|---|---|
| 255 | 1 | 1 | 1 | 1 | 1 | 1 | 1 | 1 |
| 254 | 1 | 1 | 1 | 1 | 1 | 1 | 1 | 0 |
| 253 | 1 | 1 | 1 | 1 | 1 | 1 | 0 | 1 |
| ⋮ | ⋮ | ⋮ | ⋮ | ⋮ | ⋮ | ⋮ | ⋮ | ⋮ |
| 2 | 0 | 0 | 0 | 0 | 0 | 0 | 1 | 0 |
| 1 | 0 | 0 | 0 | 0 | 0 | 0 | 0 | 1 |
| 0 | 0 | 0 | 0 | 0 | 0 | 0 | 0 | 0 |

→

| GRAY LEVEL | IMAGE DATA (8 BITS) | | | | | | | |
|---|---|---|---|---|---|---|---|---|
| 255 | 1 | 1 | 1 | 1 | 1 | 1 | 1 | 1 |
| 254 | 1 | 1 | 1 | 1 | 1 | 1 | 1 | 0 |
| 253 | 1 | 1 | 1 | 1 | 1 | 1 | 0 | 1 |
| ⋮ | ⋮ | ⋮ | ⋮ | ⋮ | ⋮ | ⋮ | ⋮ | ⋮ |
| 2 | 0 | 0 | 0 | 0 | 0 | 0 | 1 | 0 |
| 1 | 0 | 0 | 0 | 0 | 0 | 0 | 0 | 1 |
| 0 | 0 | 0 | 0 | 0 | 0 | 0 | 0 | 0 |

FIG. 7B

| GRAY LEVEL | IMAGE DATA (6 BITS) | | | | | |
|---|---|---|---|---|---|---|
| 63 | 1 | 1 | 1 | 1 | 1 | 1 |
| 62 | 1 | 1 | 1 | 1 | 1 | 0 |
| 61 | 1 | 1 | 1 | 1 | 0 | 1 |
| ⋮ | ⋮ | ⋮ | ⋮ | ⋮ | ⋮ | ⋮ |
| 2 | 0 | 0 | 0 | 0 | 1 | 0 |
| 1 | 0 | 0 | 0 | 0 | 0 | 1 |
| 0 | 0 | 0 | 0 | 0 | 0 | 0 |

→

| GRAY LEVEL | IMAGE DATA (8 BITS) | | | | | | | | |
|---|---|---|---|---|---|---|---|---|---|
| 63 | 1 | 1 | 1 | 1 | 1 | 1 | 1 | 1 | → (255) |
| 62 | 1 | 1 | 1 | 1 | 1 | 0 | 1 | 1 | → (251) |
| 61 | 1 | 1 | 1 | 1 | 0 | 1 | 1 | 1 | → (247) |
| ⋮ | ⋮ | ⋮ | ⋮ | ⋮ | ⋮ | ⋮ | ⋮ | ⋮ | ⋮ |
| 2 | 0 | 0 | 0 | 0 | 1 | 0 | 1 | 1 | → (11) |
| 1 | 0 | 0 | 0 | 0 | 0 | 1 | 1 | 1 | → (7) |
| 0 | 0 | 0 | 0 | 0 | 0 | 0 | 0 | 0 | → (0) |

DRIVING CIRCUIT OF DISPLAY DEVICE FOR COMPENSATING IMAGE DATA AND METHOD FOR DRIVING THE SAME

This application claims the benefit of priority to Korean Patent Application No. 10-2012-0154687 filed on Dec. 27, 2012, which is hereby incorporated by reference as if fully set forth herein.

BACKGROUND

Field of the Disclosure

The present disclosure relates to a driving circuit of a display device, and more particularly, to a driving circuit of a display device and a method for driving the same, which can readily prevent yellowish, greenish, and bluish phenomena.

Discussion of the Related Art

To prevent a yellowish phenomenon, a conventional display device includes a resistor string for each color of image data. This increases the size of a data driving chip. Moreover, since the resistance values of the resistor strings are fixed in terms of hardware, the resistor string structure is not feasible for application to panels having different characteristics.

Meanwhile, the gamma voltages of a high gray-level area in a resistor string may be selectively divided and the gamma value of a specific color may be output using the divided gamma voltages. However, this scheme also faces the same problem of a resistance value fixed in terms of hardware in the resistor string, which makes it difficult to apply the resistor string to panels having different characteristics.

Image data may be controlled by Frame Rate Control (FRC). However, this scheme requires an additional circuit for performing the FRC function, thus also increasing the size of a data driving chip.

SUMMARY

A driving circuit of a display device includes a timing controller configured to receive external image data and to output corrected image data by subtracting predetermined compensation data from the received image data, and a data driver configured to generate a data voltage for the image data based on the corrected image data received from the timing controller.

In another aspect of the present invention, a method for driving a driving circuit of a display device includes receiving external image data and outputting corrected image data by subtracting predetermined compensation data from the received image data, and generating a data voltage for the image data based on the corrected image data.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings:

FIGS. 7A and 7B illustrate operations of a bit controller illustrated in FIG. 4.

DETAILED DESCRIPTION OF THE EXEMPLARY EMBODIMENTS

Reference will now be made in detail to the embodiments of the present invention, examples of which are illustrated in the accompanying drawings. Wherever possible, the same reference numbers will be used throughout the drawings to refer to the same or like parts.

Figure 1:
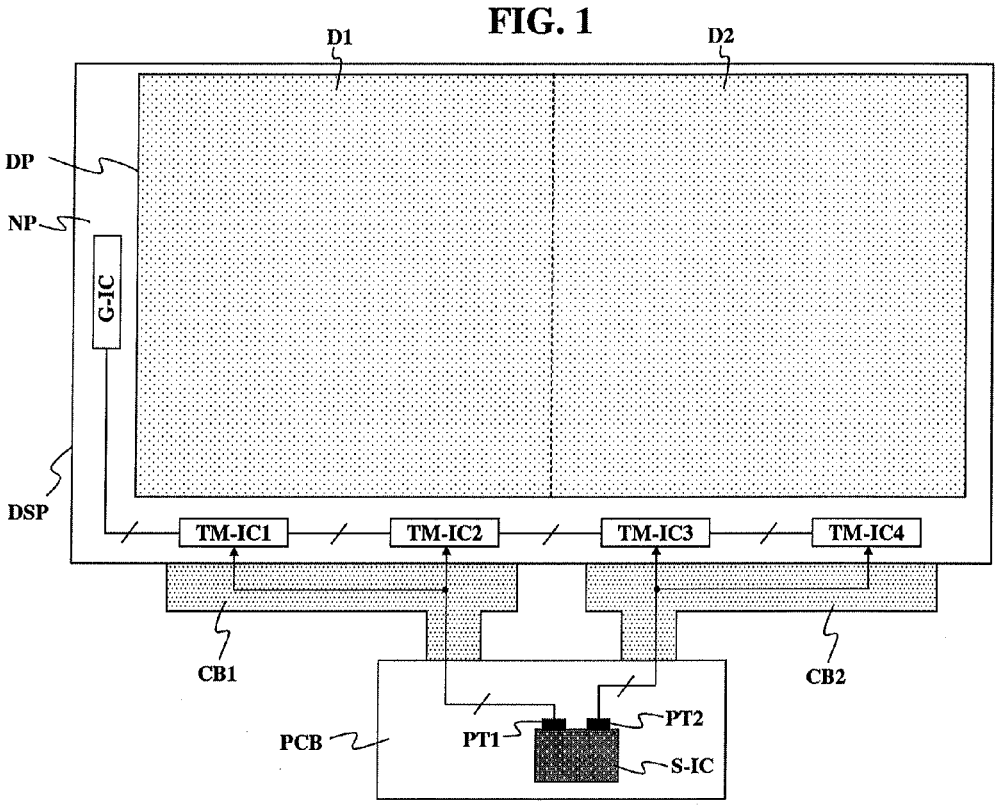
FIG. 1 illustrates a display device according to an embodiment of the present invention.
Figure 2:
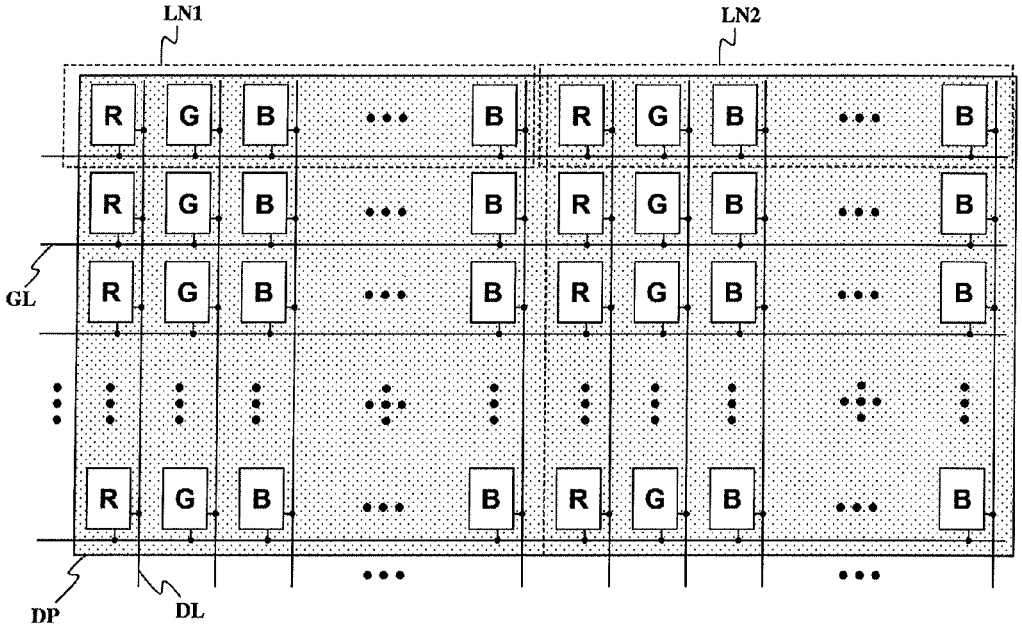
FIG. 2 illustrates a detailed configuration of a display portion illustrated in FIG. 1.

FIG. 1 illustrates a display device according to an embodiment of the present invention and FIG. 2 illustrates a detailed configuration of a display portion illustrated in FIG. 1.

Referring to FIG. 1, the display device according to the embodiment of the present invention includes a display panel DSP for displaying an image and a system chip S-IC for providing an image data signal and a control signal to the display panel DSP so that an image can be displayed on the display panel DSP.

The display panel DSP is divided into a display portion DP and a non-display portion NP. A plurality of pixels are formed on the display portion DP to display an image, whereas a plurality of data driving chips TM-IC1 to TM-IC4 and a gate driving chip G-IC are formed on the non-display portion NP. A plurality of transmission lines are formed on the non-display portion NP to connect the data driving chips TM-IC1 and TM-IC4 to the gate driving chip G-IC.

Referring to FIG. 2, the display portion DP includes a plurality of gate lines GL, a plurality of data lines DL, and a plurality of pixels R, G, and B. These pixels are arranged in a matrix on the display portion DP. The pixels are classified into pixels R representing red color, pixels G representing green color, and pixels B representing blue color. Three adjacent pixels R, G, and B connected to the same gate line GL form one unit pixel. A unit pixel displays one unit image by mixing red image data, green image data, and blue image data.

Each data driving chip TM-IC1 to TM-IC4 is formed on the non-display portion NP of the display panel DSP in a Chip-On-Glass (COG) manner. The data driving chips TM-IC1 to TM-IC4 convert image data received from the system chip S-IC to data voltages being analog signals and provide the data voltages to the data lines DL. Each data driving chip includes a built-in timing controller and a built-in data driver. That is, each of the data driving chips TM-IC1 to TM-IC4 is a Timing controller Merged Driver IC (TMIC) that performs both a timing controller function and a data driver function. Accordingly, each of the data driving chips TM-IC1 to TM-IC4 generates necessary image data and control signals using an oscillation signal generated from a built-in independent oscillator of the data driving chip. The control signals may include a horizontal synchronization signal, a vertical synchronization signal, a data enable signal, an internal source output enable signal, etc. Each TMIC generates these control signals. To synchronize the data driving chips TM-IC1 to TM-IC4 with one another in operation, at least one of the data driving chips TM-IC1 to TM-IC4 is set as a master and the other data driving chips are set as slaves. The data driving chip as the master controls the operation of the gate driving chip G-IC as well as the operations of the data driving chips set as the slaves.

The gate driving chip G-IC drives one gate line GL in every horizontal period by providing a gate signal to the gate lines GL sequentially. When a gate line GL is driven, the pixels of a horizontal line connected to the driven gate line GL are activated. As described before, the data driving chip set as the master controls the operation of the gate driving chip G-IC. Particularly, the data driving chip set as the master controls the operation of the gate driving chip G-IC in such a manner that the gate line GL can be driven after the source outputs of the data driving chips TM-IC1 to TM-IC4 are stabilized, in order to prevent left-right block dim caused by charge sharing or a slew rate.

The system chip S-IC is formed on a printed circuit board PCB. The system chip S-IC divides image data and transmits the divided image data to the respective data driving chips TM-IC1 to TM-IC4.

The system chip S-IC is electrically connected to the data driving chips TM-IC1 to TM-IC4 through a plurality of connectors CB1 and CB2 that connect the printed circuit board PCB to the display panel DSP. The connectors CB1 and CB2 may be configured as Flexible Printed Circuit boards (FPCs). A plurality of transmission lines are formed in the first connector CB1, for transmitting first divided image data received from the system chip S-IC via a first port PT1 to the first and second data driving chips TM-IC1 and TM-IC2. A plurality of transmission lines are formed in the second connector CB2, for transmitting second divided image data received from the system chip S-IC via a second port PT2 to the third and fourth data driving chips TM-IC3 and TM-IC4.

The system chip S-IC outputs the divided image data in a Low Voltage Differential Signal (LVDS) manner through an internal LVDS transmitter. Each of the data driving chips TM-IC1 to TM-IC4 receives LVDS divided image data from the system chip S-IC through an internal LVDS receiver.

The data driving chips TM-IC1 to TM-IC4 and the system chip S-IC in the display device having the above-described configuration according to the embodiment of the present invention will be described below in greater detail.

The data driving chips TM-IC1 to TM-IC4 divide the display portion DP into i (i is a larger natural number than 1) divided display portions D1 and D2, and provide divided image data to the divided display portions D1 and D2. In FIG. 1, the display portion DP is divided into the two divided display portions D1 and D2, by way of example. The plurality of data driving chips TM-IC1 to TM-IC4 provide the divided image data to the divided display portions D1 and D2 mapped to them. For example, the first and second data driving chips TM-IC1 and TM-IC2 provide the first divided image data to the first divided display portion D1, and the third and fourth data driving chips TM-IC3 and TM-IC4 provide the second divided image data to the second divided display portion D2.

The system chip S-IC generates i divided image data by dividing line image data corresponding to one horizontal line into as many data as the number of divided display portions, and outputs the i divided image data respectively through i ports PT1 and PT2. For example, if there are two divided display portions D1 and D2 as illustrated in FIG. 1, the system chip S-IC generates two divided image data and outputs the divided image data respectively through the two ports PT1 and PT2. In a specific example, image data of one horizontal line corresponding to the pixels of the horizontal line includes the first and second divided image data. The first divided image data output from the system chip S-IC includes image data corresponding to a plurality of pixels on a half horizontal line (LN1 in FIG. 2) in the first divided display portion D1 and the second divided image data output from the system chip S-IC includes image data corresponding to a plurality of pixels on a half horizontal line (LN2 in FIG. 2) in the second divided display portion D2.

The first divided image data generated from the system chip S-IC is provided to the first and second data driving chips TM-IC1 and TM-IC2 via the first port PT1, whereas the second divided image data generated from the system chip S-IC is provided to the third and fourth data driving chips TM-IC3 and TM-IC4 via the second port PT2. In other words, two data driving chips are connected per one port. That is, the first port PT1 is connected to the first and second data driving chips TM-IC1 and TM-IC2 and the second port PT2 is connected to the third and fourth data driving chips TM-IC3 and TM-IC4.

Meanwhile, the first and second data driving chips TM-IC1 and TM-IC2 receive the same first divided image data simultaneously. Herein, the first data driving chip TM-IC1 selectively samples only necessary image data from the first divided image data and provides the sampled image data to data lines DL that the first data driving chip TM-IC1 is in charge of. The second data driving chip TM-IC2 selectively samples only necessary image data from the first divided image data and provides the sampled image data to data lines DL that the second data driving chip TM-IC2 is in charge of.

Likewise, the third data driving chip TM-IC3 selectively samples only necessary image data from the second divided image data and provides the sampled image data to data lines DL that the third data driving chip TM-IC3 is in charge of. The fourth data driving chip TM-IC4 selectively samples only necessary image data from the second divided image data and provides the sampled image data to data lines DL that the fourth data driving chip TM-IC4 is in charge of.

Now the configuration of each data driving chip will be described in detail. Since all the data driving chips TM-IC1 to TM-IC4 have the same configuration, the first data driving chip TM-IC1 will be described by way of example.

Figure 3:
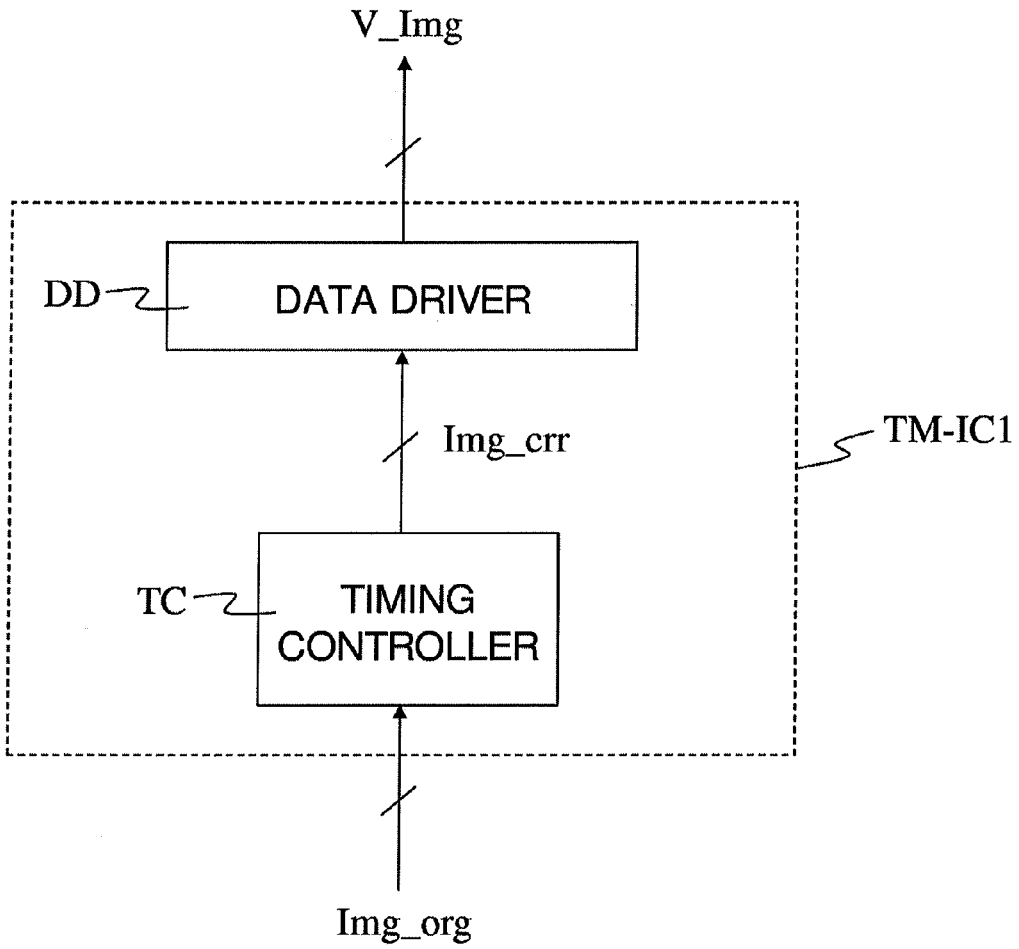
FIG. 3 is a detailed block diagram of a first data driving chip illustrated in FIG. 1.

FIG. 3 is a detailed block diagram of the first data driving chip TM-IC1 illustrated in FIG. 1.

Referring to FIG. 3, the first data driving chip TM-IC1 includes a timing controller TC and a data driver DD.

The timing controller TC receives image data Img_org from the system chip S-IC, and generates corrected image data Img_crr by subtracting predetermined compensation data from the image data Img_org, and provides the corrected image data Img_crr to the data driver DD. The compensation data has fewer bits than the image data Img_org. For example, if the image data Img_org is 8 bits, the compensation data may be 3 bits.

The data driver DD generates a data voltage V_Img for the image data Img_org based on the corrected image data Img_crr received from the timing controller TC and provides the data voltage V_Img to a corresponding data line DL.

The timing controller TC illustrated in FIG. 3 may have the following configuration.

Figure 4:
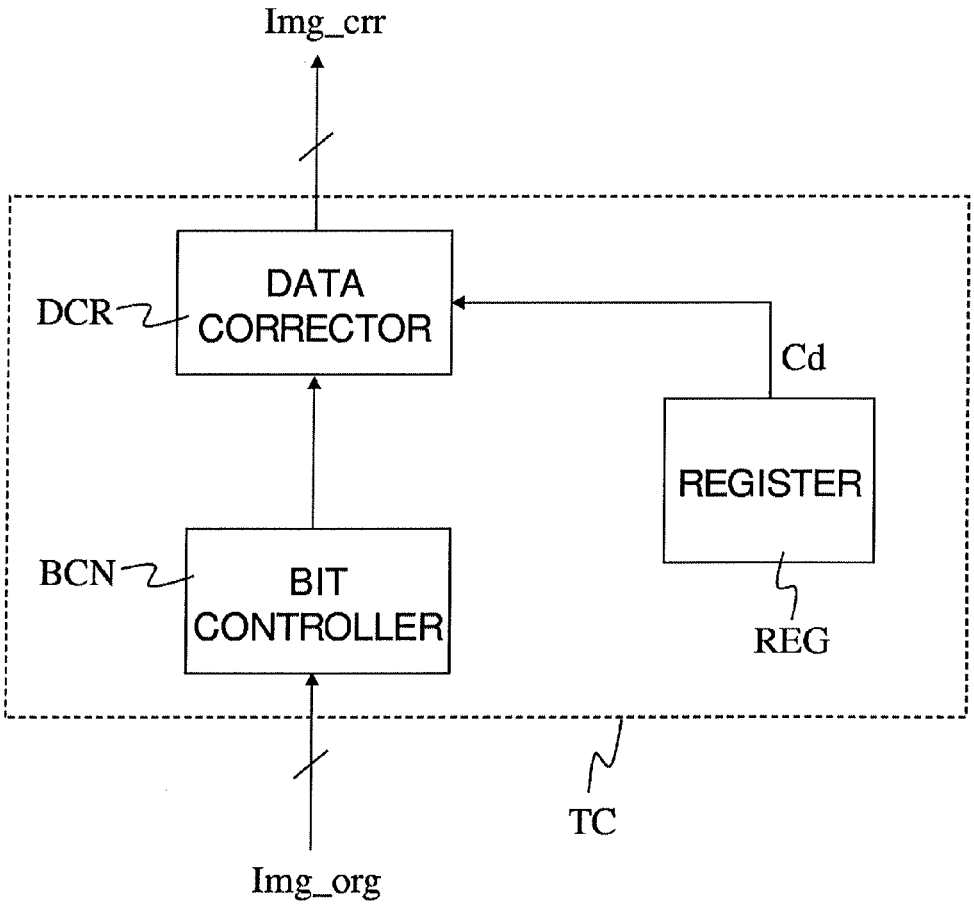
FIG. 4 is a detailed block diagram of a timing controller illustrated in FIG. 3.

FIG. 4 is a detailed block diagram of the timing controller TC illustrated in FIG. 3.

Referring to FIG. 4, the timing controller TC includes a bit controller BCN, a register REG, and a data corrector DCR.

The bit controller BCN determines whether the image data Img_org received from the system chip S-IC satisfies a predetermined reference bit number. If the bit number of the image data Img_org is equal to the reference bit number, the bit controller BCN simply outputs the image data Img_org received from the system chip S-IC without any process. On the contrary, if the bit number of the image data Img_org is different from the reference bit number, the bit controller BCN adjusts the bit number of the image data Img_org received from the system chip S-IC to be equal to the reference bit number.

Particularly, if the bit number of the image data Img_org is smaller than the reference bit number by k (k is a natural number), the bit controller BCN adds k dummy bits to the image data Img_org. The k dummy bits are added as Least Significant Bits (LSBs) of the image data Img_org. Herein, when the bit number of the image data Img_org received from the system chip S-IC is smaller than the reference bit number by k and the gray level of the image data Img_org is any gray level other than a lowest gray level (i.e. not the lowest gray level), the bit controller adds k dummy bits having a digital code of 1 to the image data Img_org. On the other hand, when the bit number of the image data Img_org received from the system chip S-IC is smaller than the reference bit number by k and the gray level of the image data Img_org is the lowest gray level, the bit controller BCN adds k dummy bits having a digital code of 0 to the image data Img_org. Image data of the lowest gray level means image data having a digital value of 0 corresponding to black.

The register REG stores compensation data Cd having a predetermined value. The value of the compensation data Cd stored in the register REG may be changed freely by an operator or a user.

The data corrector DCR receives the image data from the bit controller BCN and the compensation data Cd corresponding to the image data from the register REG, and generates corrected image data by subtracting the compensation data Cd from the image data. If the difference is smaller than 0, the data corrector DCR converts the image data to image data of the lowest gray level. The image data of the lowest gray level means image data having a digital value of 0 corresponding to black.

The image data Img_org output from the system chip S-IC includes red image data corresponding to pixels R, green image data corresponding to pixels G, and blue image data corresponding to pixels B. The image data Img_org provided to the timing controller TC may be one of the red image data, the green image data, and the blue image data. Compensation data Cd having a different value may be applied to the image data Img_org according to the color of the image data Img_org. For this purpose, the register REG may have compensation data having different values for different colors, which will be described in greater detail with reference to FIG. 5.

Figure 5:
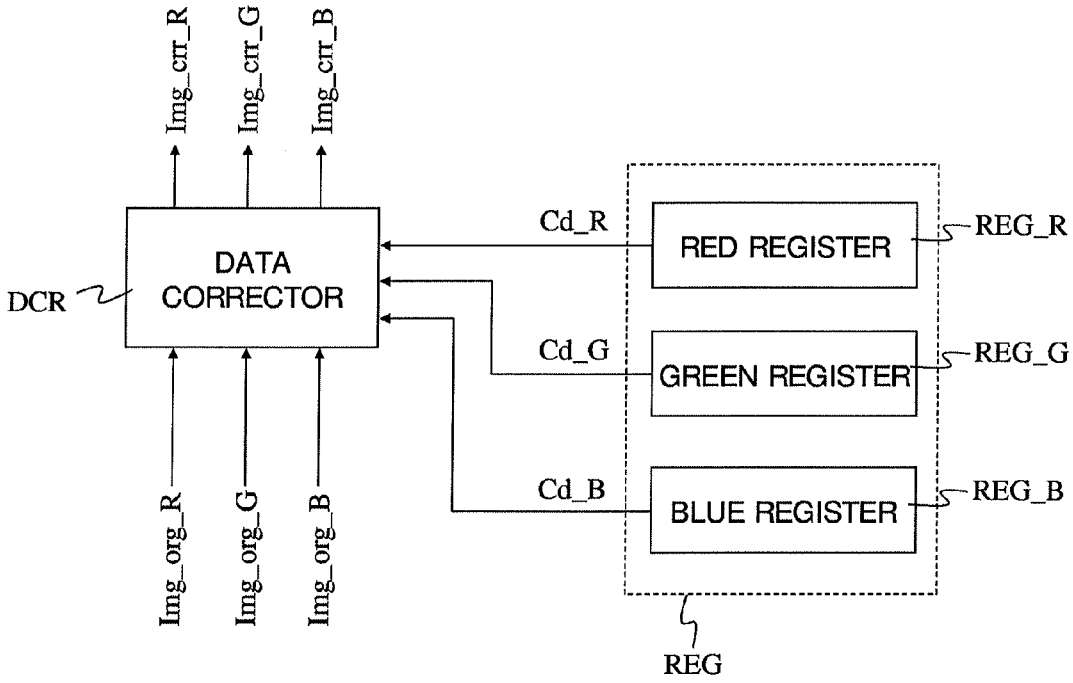
FIG. 5 is a detailed block diagram of a register illustrated in FIG. 4.

FIG. 5 is a detailed block diagram of the register REG illustrated in FIG. 4.

Referring to FIG. 5, the register REG includes a red register REG_R, a green register REG_G, and a blue register REG_B.

The red register REG_R provides compensation data for red image data Img_org_R (hereinafter, referred to as red compensation data Cd_R), the green register REG_G provides compensation data for green image data Img_org_G (hereinafter, referred to as green compensation data Cd_G), and the blue register REG_B provides compensation data for blue image data Img_org_B (hereinafter, referred to as blue compensation data Cd_B). The red, green, and blue compensation data Cd_R, Cd_G and Cd_B may have different values. For example, if compensation data is 3 bits, each of the red, green, and blue compensation data Cd_R, Cd_G and Cd_B may have one of values 000 to 111. In a specific example, the red, green, and blue compensation data Cd_R, Cd_G and Cd_B may have 111, 010, and 001, respectively. However, this is purely exemplary. Thus, the compensation data may have bits more than or fewer than 3 bits, and two or all of the red, green, and blue compensation data Cd_R, Cd_G and Cd_B may have the same value. The value of the red compensation data Cd_R stored in the red register REG_R, the value of the green compensation data Cd_R stored in the green register REG_G, and the value of the blue compensation data Cd_B stored in the blue register REG_B may be changed freely by the operator or the user.

When the register REG has the above-described configuration, the data corrector DCR determines the color of current received image data (image data received from the bit controller BCN), reads compensation data corresponding to the color from a corresponding register, and corrects the received image data using the compensation data. For example, if the data corrector DCR determines the received image data as the red image data Img_org_R, the data corrector DCR selects the red compensation data Cd_R from the red register REG_R. If the data corrector DCR determines the received image data as the green image data Img_org_G, the data corrector DCR selects the green compensation data Cd_G from the green register REG_G. If the data corrector DCR determines the received image data as the blue image data Img_org_B, the data corrector DCR selects the blue compensation data Cd_B from the blue register REG_B. Then the data corrector DCR generates red corrected image data Img_crr_R by subtracting the red compensation data Cd_R from the red image data Img_org_R, green corrected image data Img_crr_G by subtracting the green compensation data Cd_G from the green image data Img_org_g, and blue corrected image data Img_crr_B by subtracting the blue compensation data Cd_B from the blue image data Img_org_B.

Figure 6:
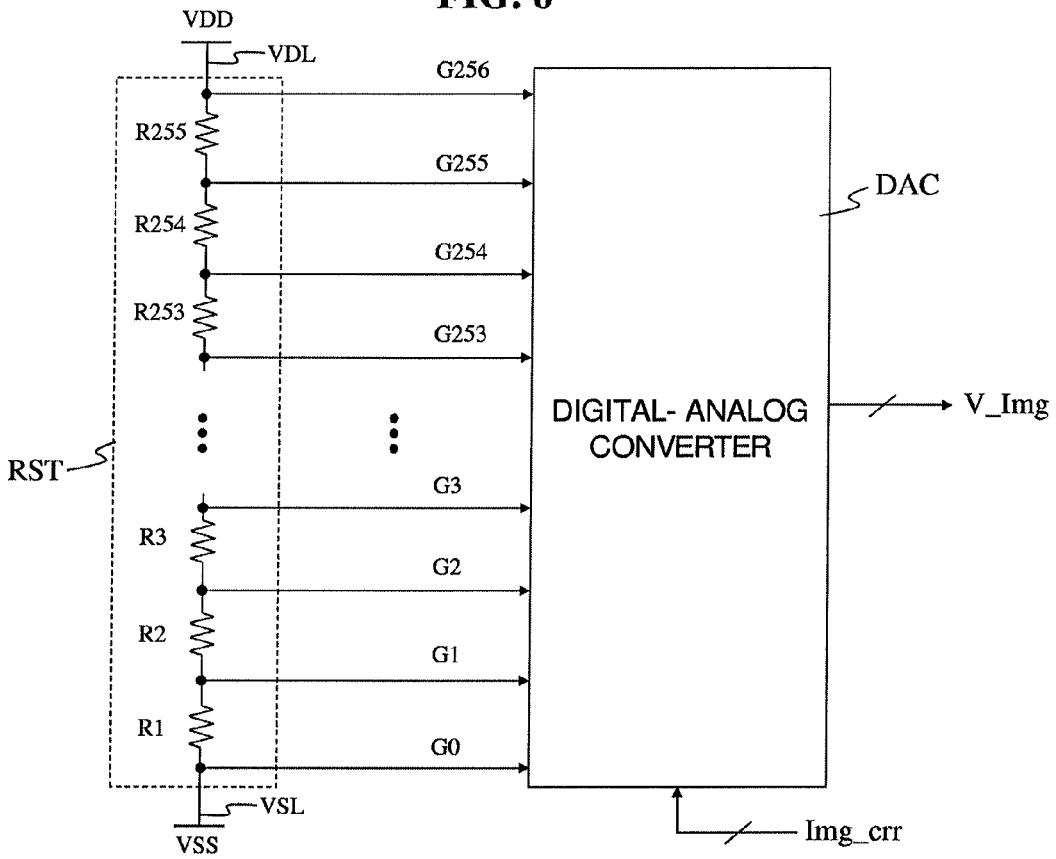
FIG. 6 is a detailed block diagram of a data driver illustrated in FIG. 3.

FIG. 6 is a detailed block diagram of the data driver DD illustrated in FIG. 3.

Referring to FIG. 6, the data driver DD includes a resistor string (RST) and a digital-to-analog converter (DAC). The data driver DD having the above configuration converts corrected image data to a data voltage being an analog signal using predetermined $2^n$ gamma voltages. Herein, n is the afore-described reference bit number. For example, if the reference bit number is 8, n is also set to 8.

The register string RST includes a plurality of resistors R1 to R255 connected serially between first and second power lines VDL and VSL. A first power voltage VDD is applied to the first power line VDL and a second power voltage VSS is applied to the second power line VSL. The first power voltage VDD is a Direct Current (DC) voltage higher than the second power voltage VSS, and the second power voltage VSS may be a ground voltage.

The first power voltage VDD, the second power voltage VSS, and 254 voltages divided from the resistors R1 to R255 are generated from the register string RST. The first power voltage VDD, the second power voltage VSS, and the 254 divided voltages are the afore-described gamma voltages.

The register string RST illustrated in FIG. 6 is configured for the case where the reference bit number is 8. The configuration of the register string RST may vary depending on reference bit numbers. 256 gamma voltages G0 to G256 in total are generated from the register string RST illustrated in FIG. 6.

The digital-to-analog converter DAC receives corrected image data from the data corrector DCR, selects a gamma voltage corresponding to the gray level of the corrected image data from the register string RST, and outputs the selected gamma voltage as a data voltage to a corresponding data line DL.

The afore-described operations of the bit controller BCN and the data corrector DCR will be described in greater detail with specific examples.

FIGS. 7A and 7B illustrate operations of the bit controller BCN illustrated in FIG. 4.

FIG. 7A illustrates an image processing method in the case where a reference bit number is 8 and image data input to the bit controller BCN has 8 bits. In this case, the bit controller BCN simply outputs the input 8-bit image data without modulation. For example, if the bit controller BCN receives 8-bit image data 00000001 with gray level 1, the bit controller BCN simply outputs the image data 00000001 without modulation. The bit controller BCN also simply outputs image data with the other gray levels without modulation.

FIG. 7B illustrates an image processing method in the case where the reference bit number is 8 and 6-bit image data is input to the bit controller BCN. In this case, the 6-bit data input to the bit controller BCN is extended to 8 bits. Specifically, 2 dummy bits having a digital code of 1 are added to the ends of image data with the other gray levels except for image data 000000 with the lowest gray level. For example, when the bit controller BCN receives G-bit image data with gray level 1, 000001, the bit controller BCN modulates the input image data to 8-bit image data 00000111. Image data with the other gray levels, gray level 2 to gray level 63 is modulated in the same manner. On the other hand, 2 dummy bits having a digital code of 0 are added to the end of 6-bit image data 000000with the lowest gray level, i.e. gray level 0. That is, the 6-bit image data 000000 is modulated to 00000000. As the 6-bit image data with gray level 0 to gray level 63 is extended to 8 bits in this manner, the gray levels of the image data with gray level 1 to gray level 63 except for the image data with gray level 0 are actually changed. That is, the 64 image data each being extended to 8 bits has one of 256 gray levels (gray level 0 to gray level 255) which are set for 8-bit image data. For example, image data with gray level 1 set for 6 bits is converted to image data with gray level 7 set for 8 bits, image data with gray level 2 set for 6 bits is converted to image data with gray level 11 set for 8 bits, image data with gray level 61 set for 6 bits is converted to image data with gray level 247 set for 8 bits, image data with gray level 62 set for 6 bits is converted to image data with gray level 251 set for 8 bits, and image data with gray level 63 set for 6 bits is converted to image data with gray level 255 set for 8 bits, as indicated by bracketed numbers in FIG. 7B. One thing to note herein is that image data with the lowest gray level (i.e. gray level 0) set for 6 bits is converted to image data with the same lowest gray level set for 8 bits. That is, the gray level of the image data with gray level 0 is not changed.

While not shown, if the bit controller BCN receives image data having bits more than the reference bit number, the bit controller BCN may remove as many LSBs of the image data as the difference between the reference bit number and the bit number of the image data. For example, if the reference bit number is 8 and the image data has 10 bits, the two LSBs of the image data may be removed.

FIGS. 8A to 8D illustrate operations of the data corrector DCR illustrated in FIG. 4.

Figure 8A:
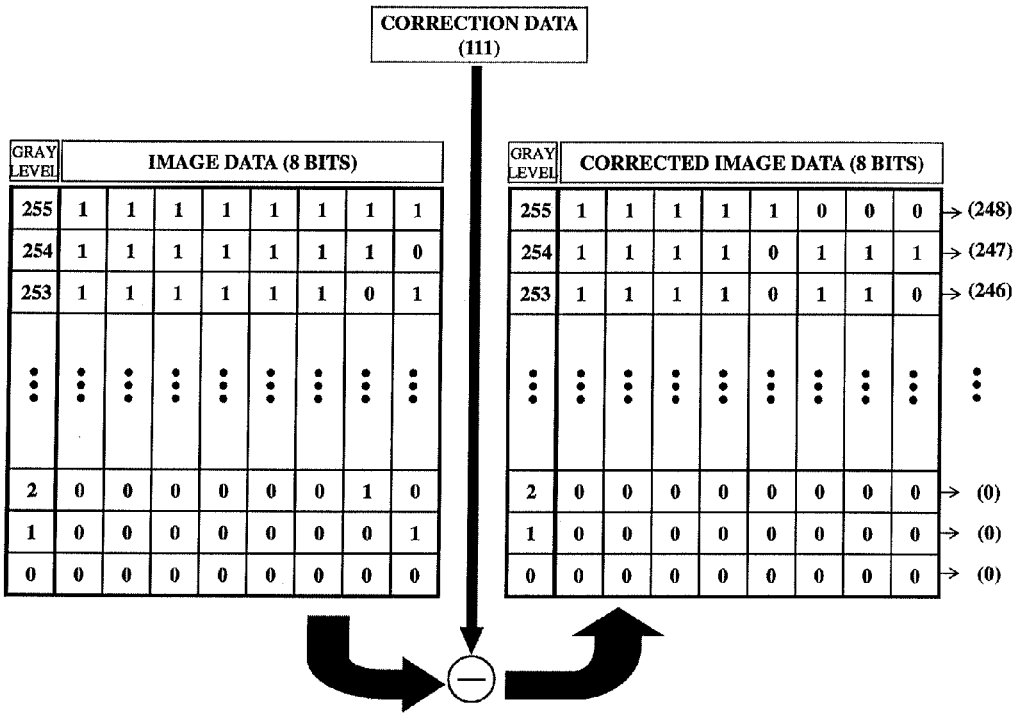
FIGS. 8A to 8D illustrate operations of a data corrector illustrated in FIG. 4.

FIG. 8A illustrates an image processing operation of the data corrector DCR, when the data corrector DCR receives 8-bit image data (i.e. image data output from the bit controller BCN) in the illustrated case of FIG. 7A. If compensation data is 111, 111 is subtracted from each 8-bit original image data and thus the resulting image data is corrected image data for the original image data, as illustrated in FIG. 8A. For example, image data 11111000 is obtained by subtracting the compensation data 111 from 8-bit image data with gray level 255, 11111111, and thus the image data 11111000 is corrected image data for the 8-bit image data with gray level 255. As indicated by bracketed numbers in FIG. 8A, the gray levels of original image data are changed according to subtraction results. For example, the 8-bit image data with gray level 255, 11111111 is modulated to image data with gray level 248. In this manner, 8-bit image data with gray level 7 to gray level 254 are corrected to image data with gray levels lower than the original gray levels by 7 levels. Meanwhile, 8-bit image data with lower gray levels than the compensation data 111 are all processed to 0s. For example, 8-bit image data with gray level 0 to gray level 6 are corrected to image data with gray level 0, 00000000.

Figure 8B:
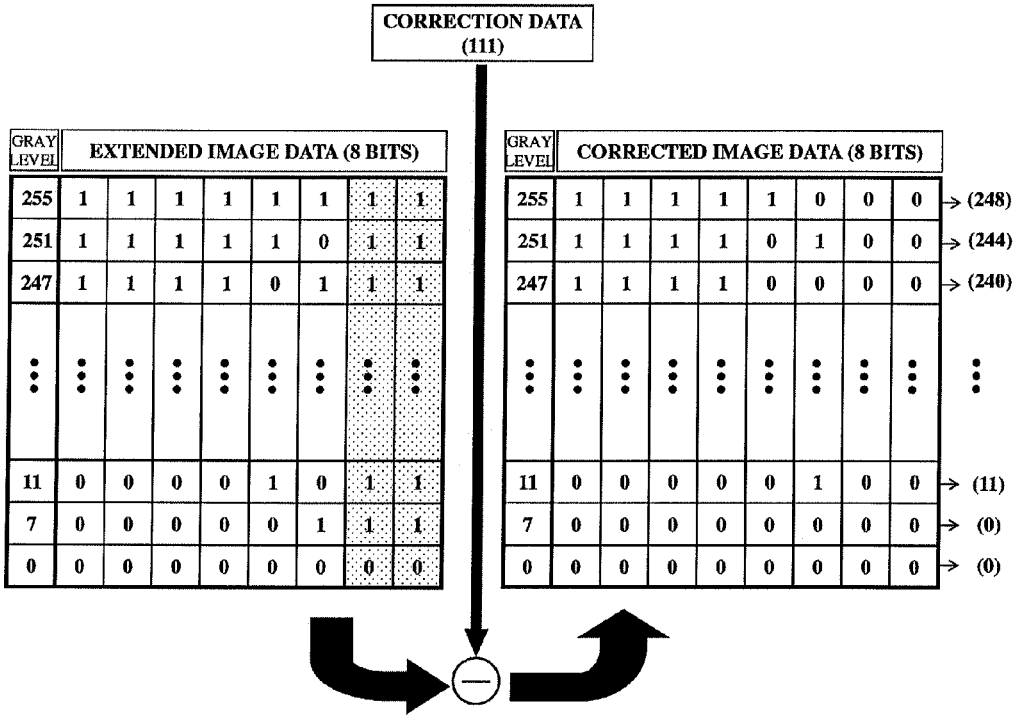

FIG. 8B illustrates an image processing operation of the data corrector DCR, when the data corrector DCR receives 8-bit image data (i.e. modulated image data output from the bit controller BCN, referred to as extended image data) in the illustrated case of FIG. 7B. If compensation data is 111, 111 is subtracted from each 8-bit extended image data and thus the resulting image data is corrected image data for the original image data, as illustrated in FIG. 8B. For example, image data 11111000 is obtained by subtracting the compensation data 111 from 8-bit extended image data with gray level 255 (gray level 63 before extension), 11111111, and thus the image data 11111000 is corrected image data for the 8-bit image data with gray level 255. As indicated by bracketed numerals in FIG. 8B, the gray levels of original image data are changed according to subtraction results. For example, the 8-bit extended image data with gray level 255, 11111111 is modulated to image data with gray level 248. In this manner, 8-bit extended image data with gray level 7, gray level 11, gray level 15, . . . , gray level 243, gray level 247, gray level 251, and gray level 255 are corrected to image data with gray levels lower than the original gray levels by 7 levels. Meanwhile, 8-bit extended image data with lower gray levels than the compensation data 111 are all processed to 0s. For example, 8-bit extended image data with gray level 0 and gray level 7 are corrected to image data with gray level 0, 00000000.

Figure 8C:
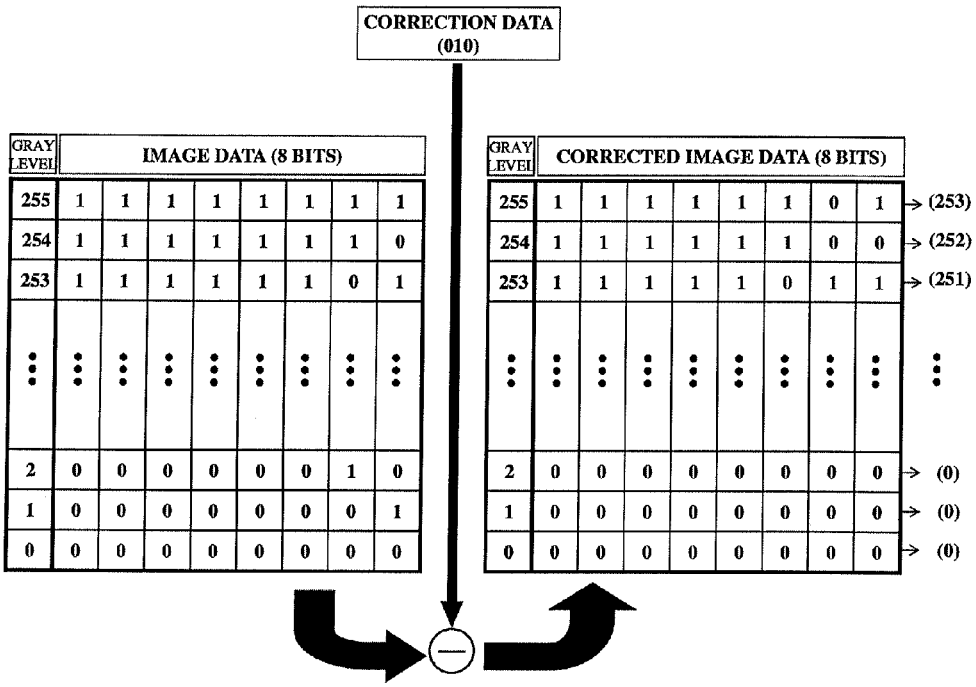

FIG. 8C illustrates an image processing operation of the data corrector DCR, when the data corrector DCR receives 8-bit image data (image data output from the bit controller BCN) in the illustrated case of FIG. 7A. It is assumed herein that compensation data is 010. The image processing operation of FIG. 8C is substantially identical to that of FIG. 8A, except that the compensation data is changed from 111 to 010. Therefore, a description of FIG. 8C is pursuant to the description of FIG. 8A.

Figure 8D:
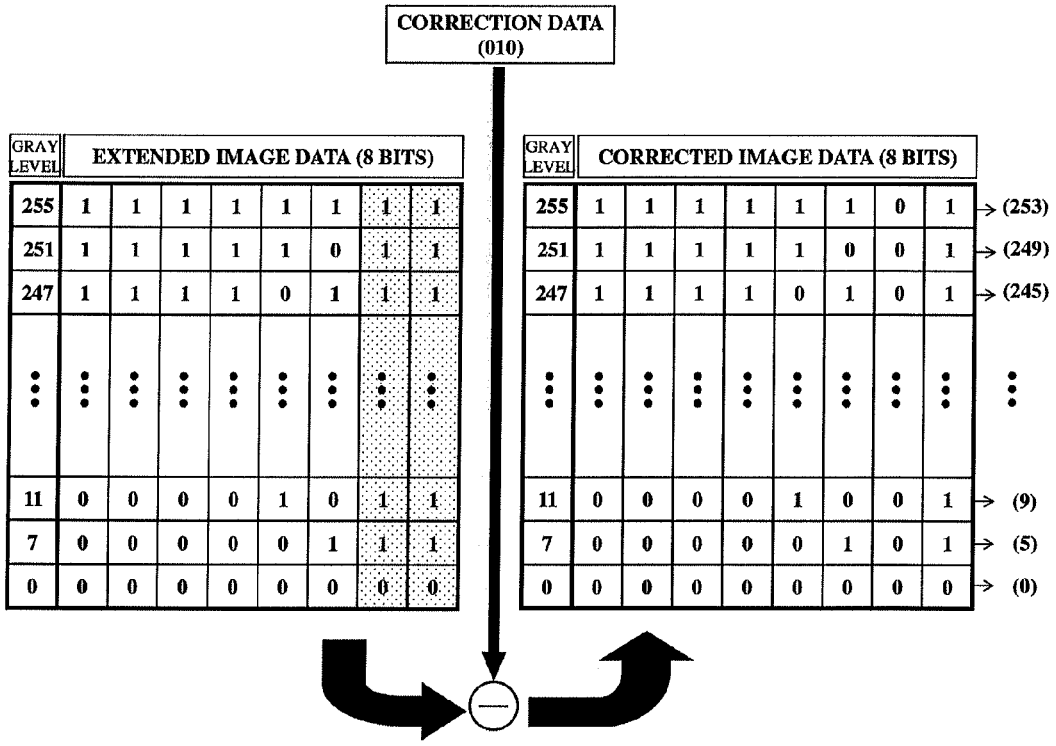

FIG. 8D illustrates an image processing operation of the data corrector DCR, when the data corrector DCR receives 8-bit image data (modulated image data output from the bit controller BCN, referred to as extended mage data) in the illustrated case of FIG. 7B. It is assumed herein that compensation data is 010. The image processing operation of FIG. 8D is substantially identical to that of FIG. 8B, except that the compensation data is changed from 111 to 010. Therefore, a description of FIG. 8D is pursuant to the description of FIG. 8B.

If the image data illustrated in FIGS. 8A and 8B are all red image data Img_org_R, the compensation data 111 is the afore-described red compensation data Cd_R. If the image data illustrated in FIGS. 8C and 8D are all green image data Img_org_G, the compensation data 010 is the afore-described green compensation data Cd_G.

According to the present invention, the gray level of original image data may be decreased or increased by setting a different compensation data value according to panel characteristics. Particularly, since the value of compensation data applied to image data can be adjusted independently according to the color of the image data, the conventional yellowish, greenish, and bluish phenomena can be eliminated.

For example, if processing of original image data (i.e. red image data Img_org_R, green image data Img_org_G, and blue image data Img_org_B) without correction causes the yellowish phenomenon, the yellowish phenomenon can be eliminated by setting the values of the red and green compensation data Cd_R and Cd_G to be higher than the blue compensation data Cd_B. If processing of the original image data (i.e. the red image data Img_org_R, the green image data Img_org_G, and the blue image data Img_org_B) without correction causes the greenish phenomenon, the greenish phenomenon can be eliminated by setting the green compensation data Cd_G to be higher than the values of the red and blue compensation data Cd_R and Cd_B. If processing of the original image data (i.e. the red image data Img_org_R, the green image data Img_org_G, and the blue image data Img_org_B) without correction causes the bluish phenomenon, the bluish phenomenon can be eliminated by setting the value of the blue compensation data Cd_B to be higher than the values of the red and green compensation data Cd_R and Cd_G.

The yellowish phenomenon refers to imparting a yellow cast to full white on a screen so that yellowish white is displayed, the greenish phenomenon refers to imparting a green cast to full white on a screen so that greenish white is displayed, and the bluish phenomenon refers to imparting a blue cast to full white on a screen so that bluish white is displayed.

As is apparent from the above description, the driving circuit of a display device and the method for driving the same according to the present invention have the following effects.

Since the gray level of original image data is modulated simply by subtracting predetermined compensation data corresponding to the color of the original image data from the original image data, the gray level of the image data can be corrected according to panel characteristics. That is, the gray level of the original image data can be decreased or increased by setting a different compensation data value according to the panel characteristics. Particularly, since different compensation data values can be set independently for different colors of image data, the conventional yellowish, greenish, and bluish phenomena can be eliminated.

Therefore, as many resistor strings as used conventionally are not used, gray levels can be changed by adjusting compensation data, and there is no need for an additional circuit to perform an FRC function. Consequently, the size of a data driving chip can be reduced.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A driving circuit of a display device, comprising:

a timing controller including a register unit including a red register providing predetermined red compensation data for red image data, a green register providing predetermined green compensation data for green image data, and a blue register providing predetermined blue compensation data for blue image data, and a data corrector which receives external image data having a first color and having a first bit number and selects one of the predetermined red, green and blue compensation data corresponding to the first color and having a second bit number from the register unit, the first bit number being larger than the second bit number, wherein the data corrector generates and outputs corrected image data by subtracting the predetermined compensation data from least significant bits of the received image data; and a data driver configured to generate a data voltage for the image data based on the corrected image data received from the timing controller.

2. The driving circuit according to claim 1, wherein the timing controller further comprises a bit controller configured to determine whether the received external image data satisfies a predetermined reference bit number, to output the received external image data, if the number of bits of the image data is equal to the reference bit number, or to adjust the number of bits of the image data to be equal to the reference bit number, if the number of bits of the image data is different from the reference bit number.

3. The driving circuit according to claim 2, wherein if the number of bits of the received external image data is smaller than the reference bit number by k (k is a natural number), the bit controller adds k dummy bits as Least Significant Bits (LSBs) to the image data.

4. The driving circuit according to claim 3, wherein if the number of bits of the received external image data is smaller than the reference bit number by k and a gray level of the received external image data is not a lowest gray level, the bit controller adds k dummy bits having a digital code of 1 to the image data, and if the number of bits of the received external image data is smaller than the reference bit number by k and the gray level of the received external image data is the lowest gray level, the bit controller adds k dummy bits having a digital code of 0 to the image data.

5. The driving circuit according to claim 2, wherein if a difference obtained by subtracting the predetermined compensation data from the image data is smaller than 0, the data corrector converts the image data to image data having a lowest gray level.

6. The driving circuit according to claim 4, wherein the image data having the lowest gray level is image data having a digital value of 0 corresponding to black.

7. The driving circuit according to claim 2, wherein the data driver converts the corrected image data to the data voltage using predetermined $2^n$ gamma voltages, n being equal to the reference bit number.

8. The driving circuit according to claim 1, wherein the received external image data is one of the red image data corresponding to a red pixel, the green image data corresponding to a green pixel, and the blue image data corresponding to a blue pixel, and the predetermined compensation data includes the predetermined red compensation data for the red image data, the predetermined green compensation data for the green image data, and the predetermined blue compensation data for the blue image data.

9. The driving circuit according to claim 8, wherein the predetermined red compensation data, the predetermined green compensation data, and the predetermined blue compensation data have different values.

10. The driving circuit according to claim 1, wherein the timing controller and the data driver are built in a single data driving chip.

11. A method for driving a driving circuit of a display device, the method comprising:

receiving external image data having a first bit number;

separately providing, by different registers, predetermined red compensation data, predetermined green compensation data, and predetermined blue compensation data for red image data, green image data, and blue image data, respectively, the predetermined red, green and predetermined blue compensation data each having a second bit number fewer than the first bit number;

outputting corrected image data by subtracting predetermined compensation data from least significant bits of the received image data; and generating a data voltage for the image data based on the corrected image data.

12. The method according to claim 11, wherein generating the data voltage comprises:

determining whether the received external image data satisfies a predetermined reference bit number, outputting the received external image data, if the number of bits of the image data is equal to the reference bit number, or adjusting the number of bits of the image data to be equal to the reference bit number, if the number of bits of the image data is different from the reference bit number.

13. The method according to claim 12, wherein determining whether the received external image data satisfies a predetermined reference bit number comprises, if the number of bits of the received external image data is smaller than the reference bit number by k (k is a natural number), adding k dummy bits as Least Significant Bits (LSBs) to the image data.

14. The method according to claim 13, wherein determining whether the received external image data satisfies a predetermined reference bit number comprises:

adding k dummy bits having a digital code of 1 to the image data, if the number of bits of the received external image data is smaller than the reference bit number by k and a gray level of the received external image data is not a lowest gray level; and adding k dummy bits having a digital code of 0 to the image data, if the number of bits of the received external image data is smaller than the reference bit number by k and the gray level of the received external image data is the lowest gray level.

15. The method according to claim 14, wherein the image data having the lowest gray level is image data having a digital value of 0 corresponding to black.

16. The method according to claim 12, wherein generating a data voltage for the image data based on the corrected image data comprises, if a difference obtained by subtracting the predetermined compensation data from the image data is smaller than 0, converting the image data to image data having a lowest gray level.

17. The method according to claim 12, wherein generating a data voltage for the image data based on the corrected image data comprises converting the corrected image data to the data voltage using predetermined $2^n$ gamma voltages, n being equal to the reference bit number.

18. The method according to claim 11, wherein the received external image data is one of the red image data corresponding to a red pixel, the green image data corresponding to a green pixel, and the blue image data corresponding to a blue pixel, and the predetermined compensation data includes the predetermined red compensation data for the red image data, the green compensation data for the green image data, and the blue compensation data based for blue image data.

19. The method according to claim 18, wherein the predetermined red compensation data, the predetermined green compensation data, and the predetermined blue compensation data have different values.

* * * * *